United States Patent [19]

Edwall et al.

[11] 4,282,715

[45] Aug. 11, 1981

[54] METHOD AND APPARATUS FOR PREVENTING CORROSION IN A STEAM POWER PLANT

[76] Inventors: Bengt Edwall, Svartesjo, S-274 CC Skurup; Anders Kullendorff, Linnevagen 33, S-61600 Aby, both of Sweden

[21] Appl. No.: 960,017

[22] Filed: Nov. 13, 1978

[30] Foreign Application Priority Data

Nov. 11, 1977 [SE] Sweden ..... 7712753

[51] Int. Cl.[3] ..... F01K 21/06

[52] U.S. Cl. ..... 60/646; 252/68; 60/657

[58] Field of Search ..... 60/644, 646, 657, 670; 252/58; 415/115, 116, 117

[56] References Cited

U.S. PATENT DOCUMENTS 1,666,523 4/1928 Bailey ..... 60/646

FOREIGN PATENT DOCUMENTS 1194742 11/1959 France ..... 60/657

*Primary Examiner*—Allen M. Ostrager
*Assistant Examiner*—Stephen F. Husar
*Attorney, Agent, or Firm*—Burns, Doane, Swecker & Mathis

[57] ABSTRACT

A steam power plant includes a nuclear reactor for generating a supply of steam. The steam is conducted to a first turbine which forms a high pressure stage of the steam power plant. A second turbine which is located downstream of the first turbine forms an intermediate pressure stage. Additional turbines may be arranged so as to provide still lower pressure stages for the power plant. To prevent corrosion, hydrogen peroxide is added to the steam immediately upstream of the first turbine. Additional hydrogen peroxide may be added immediately upstream of subsequent turbines. The hydrogen peroxide is added by spraying and is preferably supplied in a concentration of 25 to 50 parts per billion of steam. Preferably, the hydrogen peroxide is in a concentration of 1% to 5% prior to spraying.

13 Claims, 1 Drawing Figure

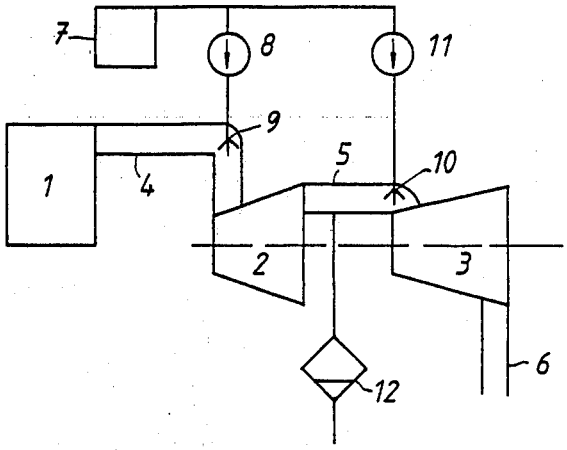
7
8
11
9
5
10
1
4
2
3
6
12

METHOD AND APPARATUS FOR PREVENTING CORROSION IN A STEAM POWER PLANT

BACKGROUND AND SUMMARY OF THE PRESENT INVENTION

The present invention relates generally to a steam power plant having a multistage turbine which is fed by a nuclear reactor of the boiling reactor type.

A power plant of this type typically operates without a superheater for the high-pressure steam. Accordingly, supersaturated wet steam will develop due to the lack of a superheater. The wet steam occurs primarily in the lower pressure stages, in other words downstream of the high-pressure stage. Such hot, wet steam will have a highly corrosive effect on iron surfaces, especially in the temperature range of 150° C. to 180° C. The highly corrosive effect is due to the fact that the water which precipitates from the wet steam and is deposited on the surfaces of the steam conduits, has a very low oxygen content in this specific temperature range. Therefore, a protective oxide film can not form on the surfaces with the result that corrosion can and will spread throughout the steam conduits.

The water film within the steam conduits will have a low content of oxygen even though the oxygen content of the steam inside the reactor can be high due to radiolysis. This phenomenon is caused by the fact that the oxygen distribution between the water and the steam will greatly favor the steam phase in this specific temperature range. It is for this reason that the problem of corrosion can not be solved by the admission of pure oxygen to the steam.

To overcome the problems of the prior art, the invention includes the admixture of hydrogen peroxide to the steam, to be accomplished most advantageously by blowing hydrogen peroxide in a suitably dissolved state into the flow of steam. The hydrogen peroxide will thus dissolve in water droplets of the steam. Computations indicate that the hydrogen peroxide will remain effective for a period of time that is sufficient to build up and maintain an oxide film at the steel surfaces that are subjected to the hot and wet steam.

The use of hydrogen peroxide as an agent for corrosion prevention in conventional steam power plants is known per se but only as an additive to the condensation product and to the feed water. There is hardly any danger of corrosion in the steam section of such plants because the plants operate with superheated steam entirely at a sufficiently high temperature level. On the other hand, there is no need for an admixture of additional oxygen to the condensation product and to the feed water of a nuclear power plant because the oxygen, which is produced by the radiolysis in the reactor, can supply the condensation product and feed water with the desired oxygen content in the water.

The admixture of hydrogen peroxide is necessary in sections where wet, hot steam is present, in other words immediately after the high-pressure stage of the turbine. In order to attain a proper distribution of the additive, it will be expedient to admix it in front of the high-pressure stage.

BRIEF DESCRIPTION OF THE DRAWINGS

A preferred embodiment of the present invention will be described with reference to the single accompanying FIGURE which is a schematic illustration of a steam power plant having devices for blowing-in a hydrogen peroxide solution in accordance with the present invention.

DETAILED DESCRIPTION OF THE PREFERRED EMBODIMENT

With reference to the single drawing, a nuclear power plant includes a reactor 1. A high-pressure stage turbine 2 and an intermediate pressure stage turbine 3 are supplied with steam from the reactor 1. The plant also includes a low-pressure stage turbine, a condenser and a feed water system which are not shown in the drawing. The steam moves from the reactor through a conduit 4 to the high-pressure stage turbine and then from the high-pressure stage turbine by way of a conduit 5 to the intermediate-pressure stage turbine. From the intermediate-pressure stage turbine the steam then flows through a conduit 6 to the low-pressure stage turbine (not illustrated).

The conduit 5 and a discharge housing of the high-pressure stage 2 include the primary sections of the steam power plant which are subjected to hot, wet steam. Corresponding parts downstream of the intermediate-pressure stage turbine 3 can also be affected by the hot, wet steam. In order to protect the discharge side of the high-pressure stage turbine, devices are provided to blow-in a hydrogen peroxide solution in front of the high-pressure stage turbine. The devices include a container 7 for the solution, a pump 8 and one or more spray nozzles 9 for the fine distribution of the solution within the flow of steam. The spray nozzles 9 are most advantageously placed immediately upstream of the high-pressure stage turbine to insure that the solution will be distributed throughout the entire volume of steam when the steam reaches the discharge side of the high-pressure stage turbine.

It is important to place the spray nozzles inside the flow of steam in such a manner that the nozzles will be fully surrounded by the steam. The proper arrangement of the nozzles should furthermore avoid any local precipitation of the solution in the vicinity of the spray nozzles.

The discharge side of the intermediate-pressure stage turbine can be protected in the same manner according to the present invention by blowing in a hydrogen peroxide solution through one or more spray nozzles 10 which are placed in front of the intermediate-pressure stage turbine. The nozzles 10 are supplied with the hydrogen peroxide solution by a pump 11 which receives the solution from the container 7.

With respect to the quantities and the concentrations of the hydrogen peroxide solution to be used, it has been found that the desired degree of protection can be attained if the concentration of the hydrogen peroxide in the film of water at the exposed steel surfaces is in the magnitude of 100 to $200/10^9$ (parts per billion). This concentration corresponds in the case of the actual moisture content to a concentration of approximately 25 to $50/10^9$ (parts per billion) in proportion to the entire flow of steam.

The hydrogen peroxide is admixed most advantageously in a solution which has a concentration of approximately 1 to 5% prior to spraying. If suitable stabilizers (for example phosphoric acid) and corrosion inhibitors are added, the hydrogen peroxide will have a half-life of approximately one hour under the existing conditions. This extent of durability is typically sufficient for the purpose desired.

It will be expedient to monitor the proper dosage of the hydrogen peroxide by testing specimens from a moisture separator 12. The separator 12 is preferably placed at the discharge end of the high-pressure stage turbine.

The principles, preferred embodiments and modes of operation of the present invention have been described in the foregoing specification. The invention which is intended to be protected herein, however, is not to be construed as limited to the particular forms disclosed, since these are to be regarded as illustrative rather than restrictive. Variations and changes may be made by those skilled in the art without departing from the spirit of the present invention.

What is claimed is:

1. A method of operating a steam power plant with corrosion prevention, comprising the steps of:

generating a supply of steam;

adding hydrogen peroxide to the steam;

supplying the steam to a first turbine; and, driving the first turbine with the steam.

2. The method of claim 1 wherein the hydrogen peroxide is added to the steam by spraying prior to supplying the steam to the first turbine.

3. The method of claim 1 wherein the hydrogen peroxide is added in a concentration of 25 to 50 parts per billion parts of steam.

4. The method of claim 3 wherein the hydrogen peroxide has a concentration of 1% to 5% immediately prior to being added to the steam.

5. The method of claim 1 further comprising the steps of:

supplying the steam from the first turbine to a second turbine; and adding additional amounts of hydrogen peroxide to the steam immediately before the steam is supplied to the second turbine.

6. The method of claim 1 further comprising the step of:

testing the concentration of the hydrogen peroxide in the steam immediately downstream of the first turbine.

7. The method of claim 1 wherein the hydrogen peroxide and the steam forms a film of water on the portions of the steam power plant to be protected with a concentration of between 100 to 200 parts per billion parts of water.

8. A steam power plant having corrosion prevention, comprising:

means for generating a supply of steam;

first turbine means for utilizing the supply of steam to produce power; and first means for adding hydrogen peroxide to the supply of steam before the steam is conducted away from the first turbine means.

9. The steam power plant of claim 8 wherein the hydrogen peroxide is added to the steam in a concentration of 25 to 50 parts per billion parts of steam.

10. The steam power plant of claim 9 wherein the hydrogen peroxide has a concentration of between 1% to 5% immediately prior to being added to the steam.

11. The steam power plant of claim 8 further comprising:

second turbine means for utilizing a supply of steam from the first turbine means to produce additional power; and second means for adding an additional amount of hydrogen peroxide to the supply of steam before the steam is conducted away from the second turbine means.

12. The steam power plant of claim 8 further comprising:

means for testing the concentration of the hydrogen peroxide in the steam immediately downstream of the first turbine means.

13. The steam power plant of claim 8 wherein the hydrogen peroxide and the steam forms a film on the portions of the power plant to be protected with a concentration of between 100 to 200 parts per billion parts of water.

* * * * *